US007540627B2

(12) United States Patent
Handsaker

(10) Patent No.: US 7,540,627 B2
(45) Date of Patent: Jun. 2, 2009

(54) CHANNEL LIGHT SYSTEM WITH PIVOTABLE CONNECTOR

(75) Inventor: Jerrold Handsaker, Roland, IA (US)

(73) Assignee: Innovative Lighting, Inc., Roland, IA (US)

( * ) Notice: Subject to any disclaimer, the term of this patent is extended or adjusted under 35 U.S.C. 154(b) by 52 days.

(21) Appl. No.: 11/429,727

(22) Filed: May 8, 2006

(65) Prior Publication Data

US 2007/0258238 A1 Nov. 8, 2007

(51) Int. Cl.
*F21S 4/00* (2006.01)

(52) U.S. Cl. ..... 362/225; 362/220; 362/250; 362/418; 439/115; 439/119

(58) Field of Classification Search ..... 362/219, 362/220, 225, 250, 418, 152, 153; 439/110, 439/115, 119

See application file for complete search history.

(56) References Cited

U.S. PATENT DOCUMENTS

| | | | | | |
|---|---|---|---|---|---|
| 1,987,863 | A * | 1/1935 | Murphy | 40/551 |
| 2,052,425 | A * | 8/1936 | Simeone | 362/250 |
| 2,879,319 | A * | 3/1959 | Carlson et al. | 439/213 |
| 3,221,432 | A * | 12/1965 | Gold | 40/551 |
| 4,176,896 | A * | 12/1979 | Wehling | 439/502 |
| 4,245,874 | A * | 1/1981 | Bishop | 439/94 |
| 4,439,818 | A * | 3/1984 | Scheib | 362/250 |
| 4,700,017 | A * | 10/1987 | Morand | 439/8 |
| 4,825,191 | A * | 4/1989 | Ching-Hwei | 340/472 |
| 5,655,322 | A * | 8/1997 | Howe | 40/550 |
| 5,702,176 | A * | 12/1997 | Engle | 362/219 |
| 6,297,498 | B1 * | 10/2001 | Shteynberg et al. | 250/221 |
| 6,305,822 | B1 * | 10/2001 | Lin | 362/249 |
| 6,726,348 | B2 * | 4/2004 | Gloisten | 362/372 |
| 6,773,140 | B2 * | 8/2004 | Lee | 362/249 |
| 7,118,251 | B1 * | 10/2006 | Chambers et al. | 362/311 |
| 7,142,103 | B2 * | 11/2006 | Chen et al. | 340/471 |
| 7,296,912 | B2 * | 11/2007 | Beauchamp | 362/249 |
| 2003/0081413 | A1 * | 5/2003 | Weedon | 362/219 |
| 2003/0223231 | A1 * | 12/2003 | McCarthy et al. | 362/219 |
| 2007/0153509 | A1 * | 7/2007 | Lehman et al. | 362/219 |

* cited by examiner

*Primary Examiner*—Ismael Negron
(74) *Attorney, Agent, or Firm*—Daniel A. Rosenberg; Briggs and Morgan, P.A.

(57) ABSTRACT

A lighting display system including a channel for mounting on a suitable display surface, a light secured within the channel, and an electrical means for powering the light. Preferably, the channel conforms to the shape of the light, which is a rope light, in order to releaseably retain the light. The channel can be interconnected with other channels, with caps including pivot caps, to form a lighting display suitable for mounting to an underlying surface of some types, such as a commercial or residential structure.

16 Claims, 7 Drawing Sheets

Fig. 1
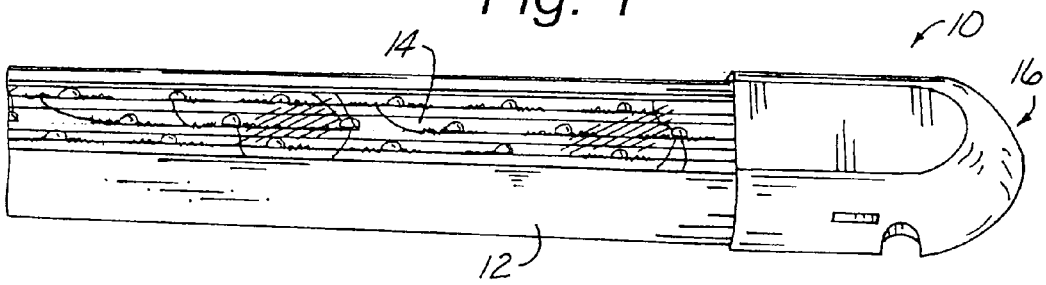
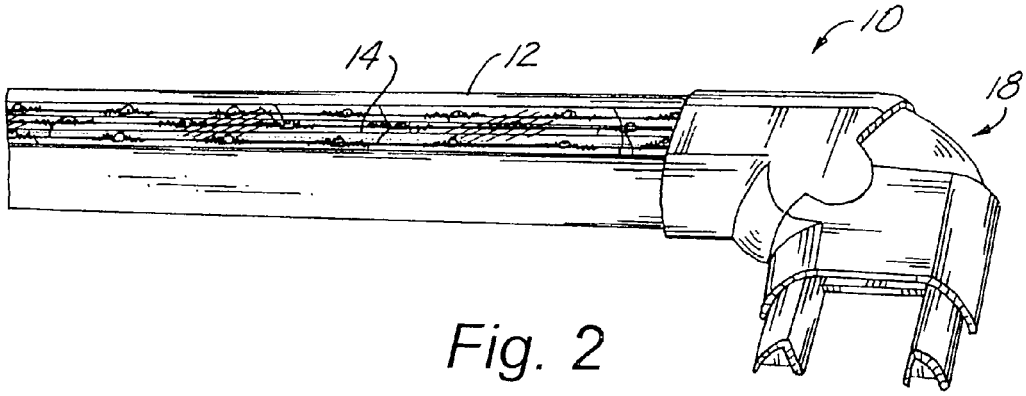
Fig. 2
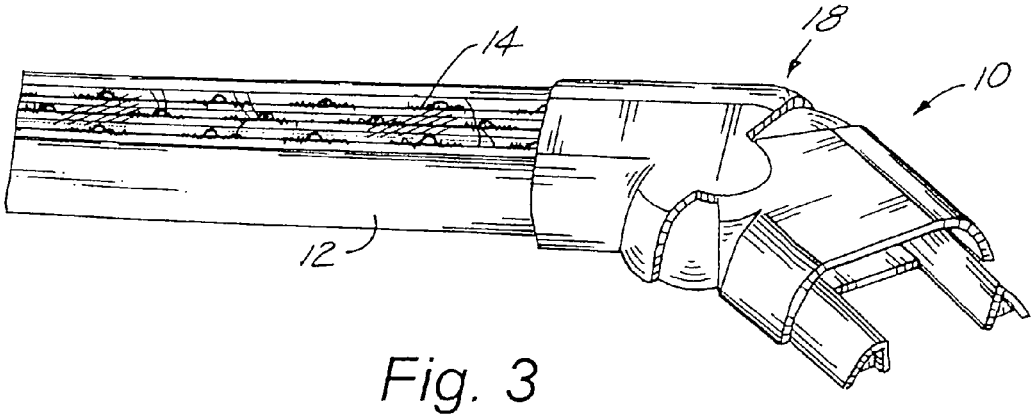
Fig. 3

CHANNEL LIGHT SYSTEM WITH PIVOTABLE CONNECTOR

BACKGROUND OF THE INVENTION

The present invention relates to a lighting display system. In particular, the invention relates to a channel for mounting on a suitable display surface, a light secured within the channel, and an electrical means for powering the light.

Lighting displays of the type used for seasonal holiday displays are well know in the art. These typically consist of a series of strings of lights strung together and connected to an electrical outlet. The lights normally are loosely affixed to the surface an article, such as a commercial or residential structure, boat, patio, and the like, with hooks, fasteners, or staples. The light are normally removed after the holiday and stored until the next holiday season.

This creates a number of problems. The installation, removal, and storage of the lights is bothersome, time consuming, and in some cases dangerous. Installation often requires the use of a ladder, and due to seasonal considerations may take place in inclement weather. Furthermore, the means of attachment often creates a display that is not pleasing. For example, the strings of lights may not be straight, and the repeated attachment and re-attachment creates wear and tear on the underlying surface.

The lights are removed due to the fact that the appearance is obtrusive and not pleasing, especially during the daytime when the lights are not illuminated. The long strings of lights make the structure look unpleasant. Additionally, conventional string lights do not weather well and are typically not suited to year round use.

Rope lighting offers an alternative that reduces some of these disadvantages. Rope lights are somewhat more durable, and can incorporate higher quality lights such as light emitting diodes. However, rope lights still need to be attached, and particularly in a manner that does not damage the lights, and then removed. Like string lights, rope lights still create an unpleasant appearance when they are not illuminated.

Accordingly, a need exists for an improved lighting system.

SUMMARY OF THE INVENTION

And object of the present invention is to provide an improved lighting display system.

These and other objects of the present invention will become apparent to those skilled in the art upon reference to the following specification, drawings, and claims.

The present invention intends to overcome the difficulties encountered heretofore. To that end, a lighting display system is provided comprising in its basic form a channel for mounting on a suitable display surface, a light secured within the channel, and an electrical means for powering the light. Preferably, the channel conforms to the shape of the light, which is a rope light, in order to releaseably retain the light. The channel can be interconnected with other channels, with caps including pivot caps, to form a lighting display suitable for mounting to an underlying surface of some types, such as a commercial or residential structure.

BRIEF DESCRIPTION OF THE DRAWINGS

FIG. 1 is a perspective view of a lighting system with an end cap.

FIG. 2 is a perspective view of the lighting system with a pivot cap.

FIG. 3 is a perspective view of the lighting system with the pivot cap.

DETAILED DESCRIPTION OF THE INVENTION

Figure 4:
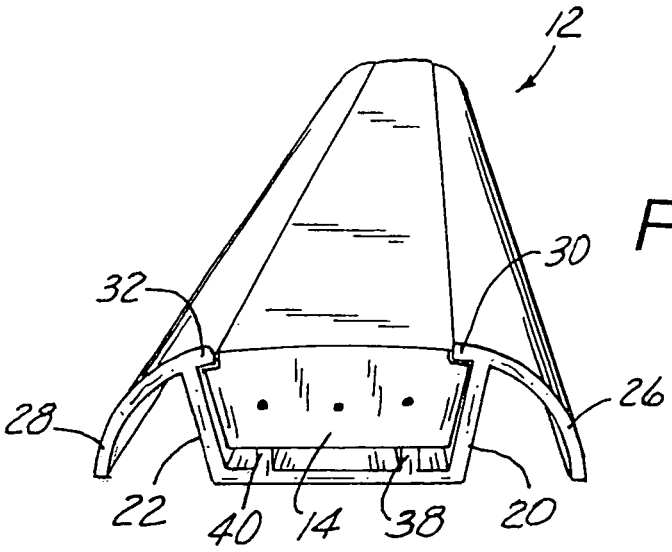
FIG. 4 is an end view of a channel and rope light of the lighting system.

In the Figures, a channel light system 10 is shown. The channel light system 10 is a modular lighting system for use as a decorative lighting system. Preferably, the system 10 utilizes LED lighting, and is permanently or semi-permanently affixed to a commercial or residential structure such as a house; or to a boat, patio, cabinets, or other similar surfaces/articles. The system 10 is particular suited for holiday display lighting, such as Christmas, New Years, Fourth of July, birthdays, and the like.

The system 10 is comprised of a channel 12, a rope light 14, a channel cap 16, and a pivot cap 18. FIG. 1 shows the channel 12 with the rope light 14 inserted therein, with the end cap 16 in place. This arrangement of the system 10 would be used at the terminal end of the system 10, to create a finished look. The channel 12 and rope light 14 feature matingly aligned profiles to form an interlocking connection when the rope light 14 is inserted into the channel 12.

FIGS. 2-3 show the system 10 with the pivot cap 18 connected to the channel 12. This arrangement of the system 10 would be used to round a corner, or fit to a curve, such as the peak or gable of a roof of a house (see FIGS. 2-3). The pivot cap 18 allows for pivoting movement of two lengths of channel 12, wherein each length would be connected to the opposite ends of the pivot cap 18.

Figure 5:
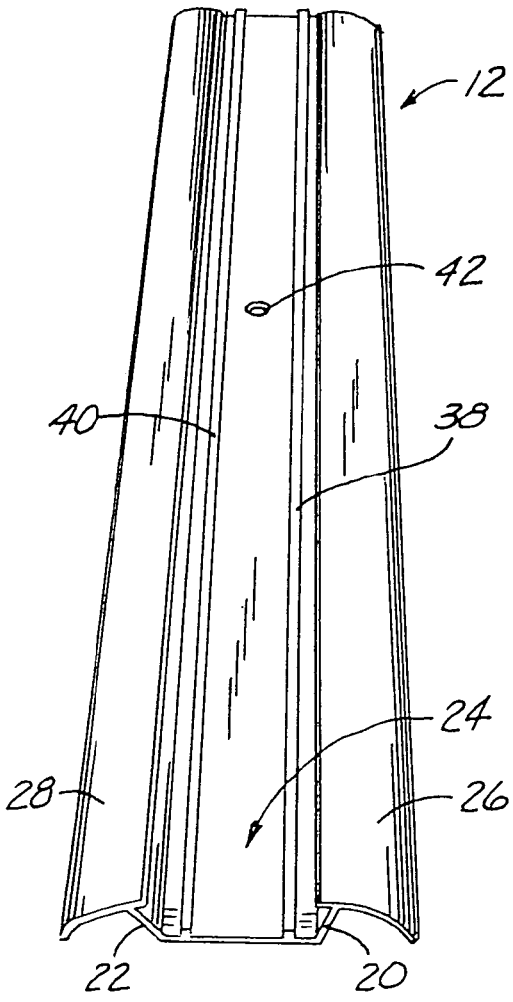
FIG. 5 is a top perspective view of the channel.
Figure 16:
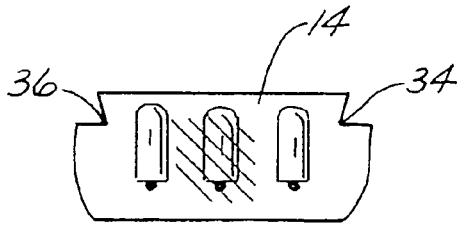
FIG. 16 is an end view of the rope light of the lighting system.

FIG. 4 shows the mating profiles of the channel 12 and the rope light 14. As shown in FIGS. 4 and 5, the channel 12 has opposing inner walls 20, 22, which create an inner channel 24 therebetween. Rounded sides 26, 28 form the exterior of the channel 12. The sides 26, 28 have terminal ledges 30, 32 that capture the correspondingly shaped inwardly depending ridges 34, 36 of the rope light 14 (see FIG. 16). In this manner, the rope light 14 is removeably retained within the inner channel 24 when the ledges 30, 32 of the sides 26, 28 of the channel 12 capture the ridges 34, 36. As disclosed hereinbelow, the rope light 14 is constructed of a semi-flexible material that allows for capture, but is not so rigid that it cannot be removed from within the inner channel 12 of the channel 12.

The channel 12 also includes raised ribs 38, 40 that extend longitudinally along the length of the channel 12. The ribs 38, 40 support the bottom of the rope light, and provide space to insert a mounting screw (not shown) that inserts into mounting holes 42 that are located periodically along the longitudinal axis of the channel 12. The gap prevents the head of the mounting screw from disturbing the rope light 14. The channel 12 can be easily mounted by securing the mounting screw through holes 42 and into an underlying surface.

The channel 12 comes in a variety of colors to match the color of the surface to which it will be mounted. For example, in the embodiment of a residential lighting display the channel 12 color can match the color of the roof, fascia, or siding of the home to create a seamless appearance particularly suited to year round display. The channel 12 can be constructed of any suitably rigid material, such as aluminum, plastic, and the like.

Figure 6:
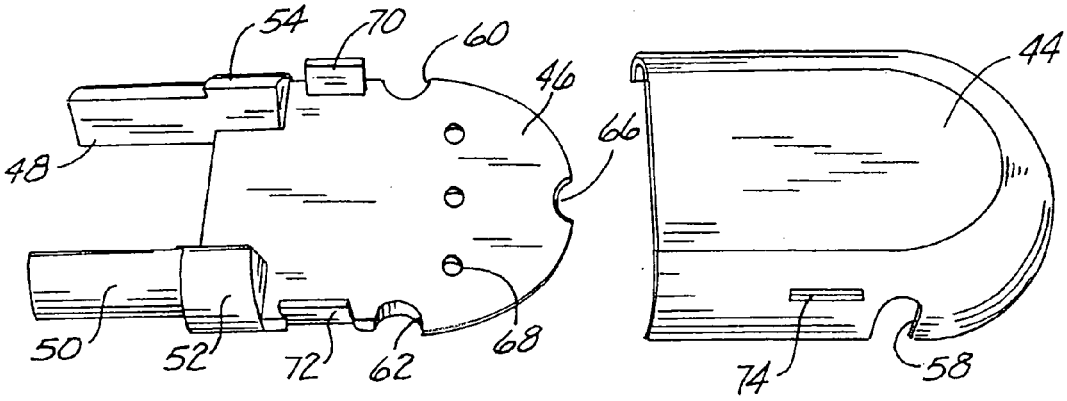
FIG. 6 is a top view of a bottom and top cap of the end cap of the lighting system.
Figure 7:
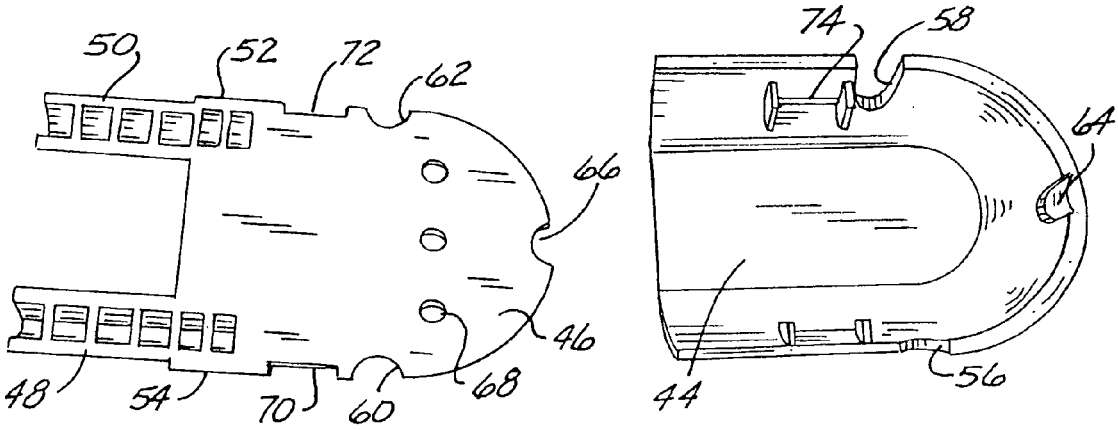
FIG. 7 is a bottom view of a bottom and top cap of the end cap of the lighting system.
Figure 8:
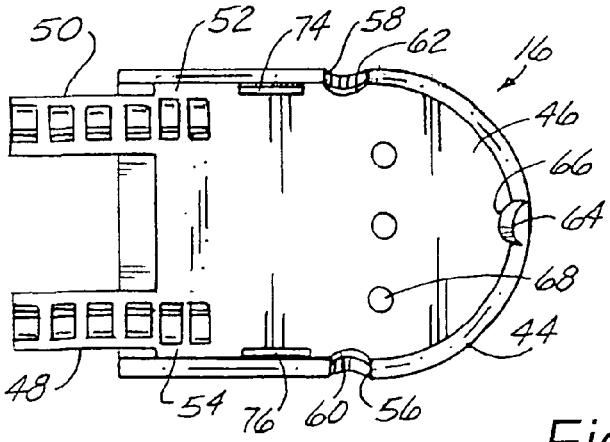
FIG. 8 is a bottom view of the end cap of the lighting system.
Figure 9:
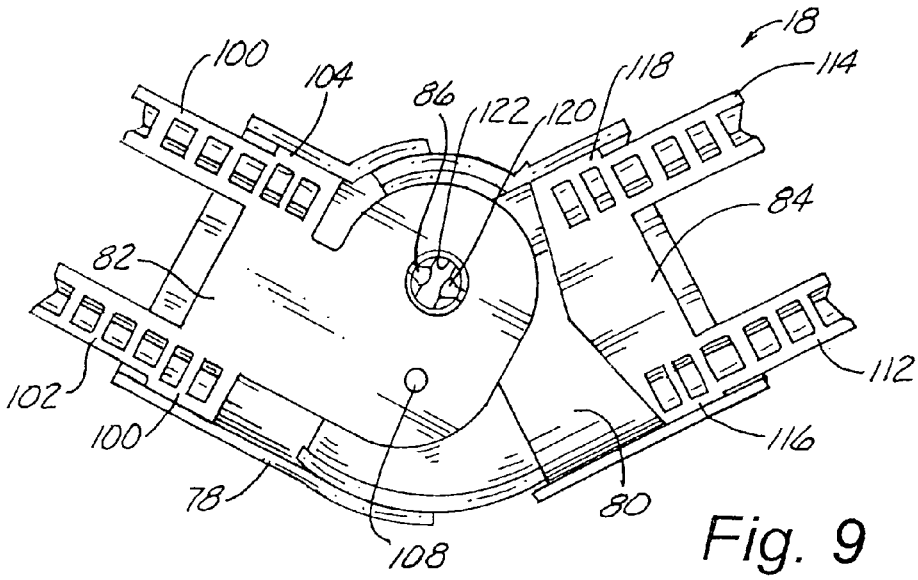
FIG. 9 is a bottom view of the pivot cap of the lighting system.
Figure 10:
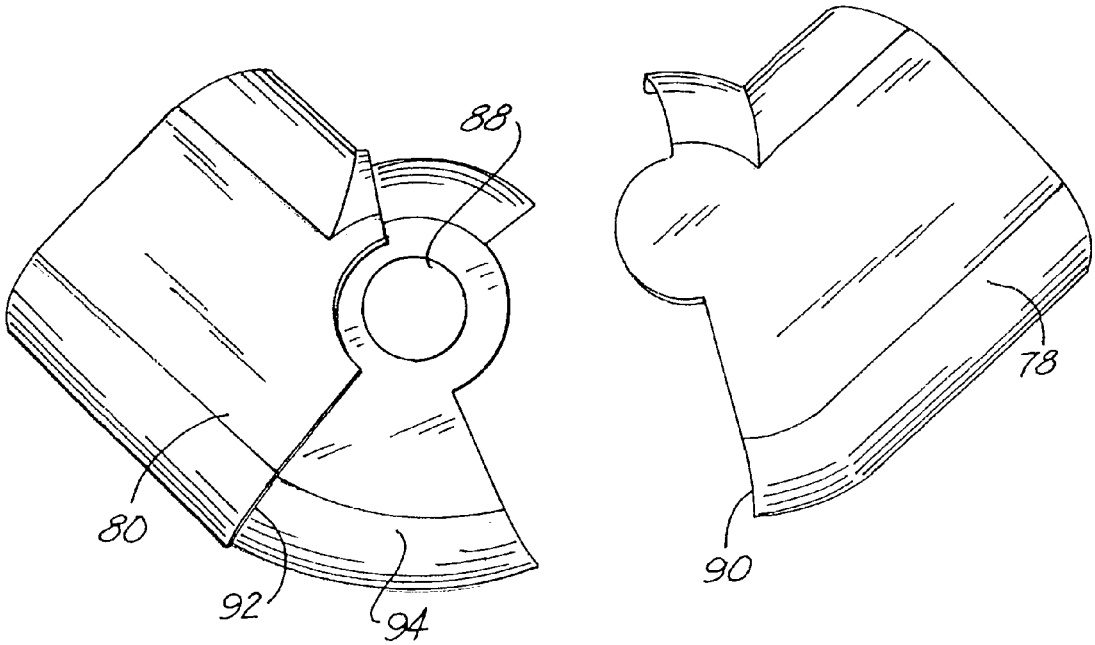
FIG. 10 is a top view of a male and female cap of the pivot cap of the lighting system.
Figure 11:
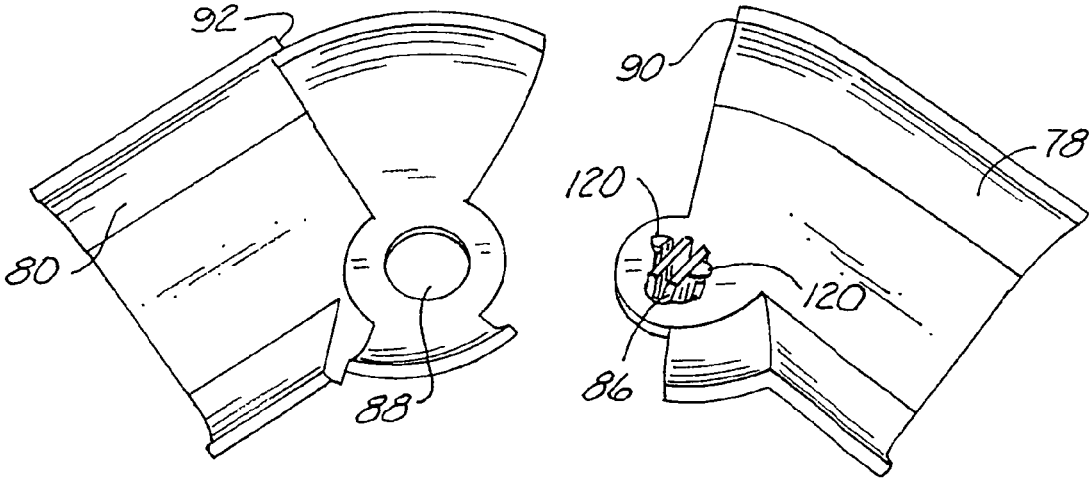
FIG. 11 is a bottom view of the male and female cap of the pivot cap of the lighting system.

FIGS. 6-8 show in detail the channel cap 16. The channel cap 16 comprises a top cap 44 that matingly aligns with a bottom cap 46. The top cap 44 provides a clean finished surface, and hides the means of securement between the channel 12 and the channel cap 16, located on the bottom cap 46. To that end, the bottom cap includes feet 48, 50 that are sized to fit snuggly into the gap between the sides 26, 28 and inner walls 20, 22 of the channel 12. Stops 52, 54 abut the edge of the channel 12 in a position so that the top cap 44 covers from view the point of joinder between the channel cap 16 and the channel 12.

The top cap 44 includes cutouts 56, 58, which align with cutouts 60, 62 located in the bottom cap 46. Together, the cutouts 56, 58, 60, 62 provide access for wires as needed to make electrical connections to the rope light 14. The bottom cap 46 includes holes 68 to insert mounting screws (not shown) to secure the bottom cap 46 to any convenient underlying surface. The bottom cap 46 utilizes upwardly extending stakes 70, 72 that fit within slots 74, 76 located in the top cap 44. Outwardly extending ledges on the stakes 70, 72 secure with the slots 74, 76 to form a removeably secure snap fit between the top and bottom caps 44, 46. The top cap 44 also includes an indentation 64, which aligns with a further cutout 66 in the bottom cap 46, and allows for the insertion of a tool such as a screwdriver to remove the top cap 44 from the bottom cap 46.

FIGS. 9-13 show in detail the pivot cap 18. The pivot cap 18 is comprised of a male cap 78, a female cap 80, a base cap 82, and a ring cap 84. The male and female caps 78, 80 present a finished surface and a pivoting connection, and hides the means of securement between the channel(s) 12 and the pivot cap 18. To that end, the male and female caps 78, 80 interlock by the insertion of a male connector 86 through hole 88 in the female cap 80. A stop ridge 90 on the male connector 78 and a correspondingly stop ridge 92 on the female connector 80 define the pivoting range of motion between the male and female caps 78, 80. The stop ridges 90, 92 extend transversely across the caps 78, 80 and make contact with each other at the limits of the pivoting movement therebetween. The female cap 80 includes a shelf 94 that provides a clean exposed surface throughout the range of movement between the caps 78, 80.

Base cap 82 includes a base portion 96 from which a collar 98 extends upward. The base cap 82 includes feet 100, 102 and stops 104, 106, which function in an identical manner as the feet and stops of the end cap 16 described herein above. The base cap 82 also includes a hole 108 through which a mounting screw (not shown) can be inserted to mount the base cap 82 to a suitable underlying surface.

The ring cap 84 includes a ring 110, which fits around the collar 98 of the base cap 82. The overlay of the ring 110 and collar 98 defines the pivot point between the base cap 82 and the ring cap 84, as well as the pivot point of the pivot cap 18. The ring cap 84 also includes feet 112, 114 and stops 116, 118, which function in an identical manner as the feet and stops of the end and base caps 16, 82 described herein above.

Figure 12:
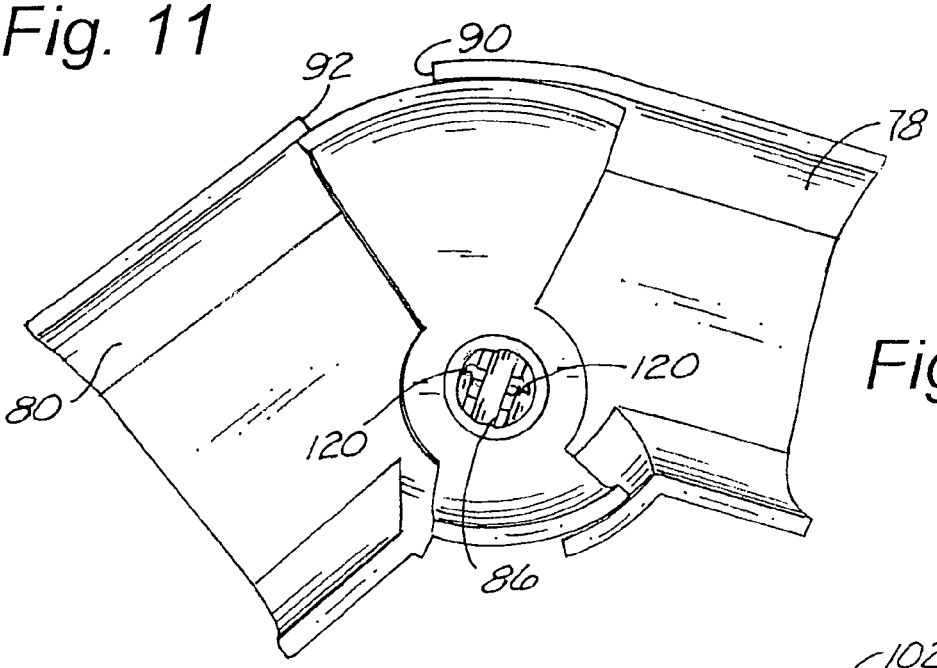
FIG. 12 is a bottom view of the male and female cap of the pivot cap of the lighting system.
Figure 13:
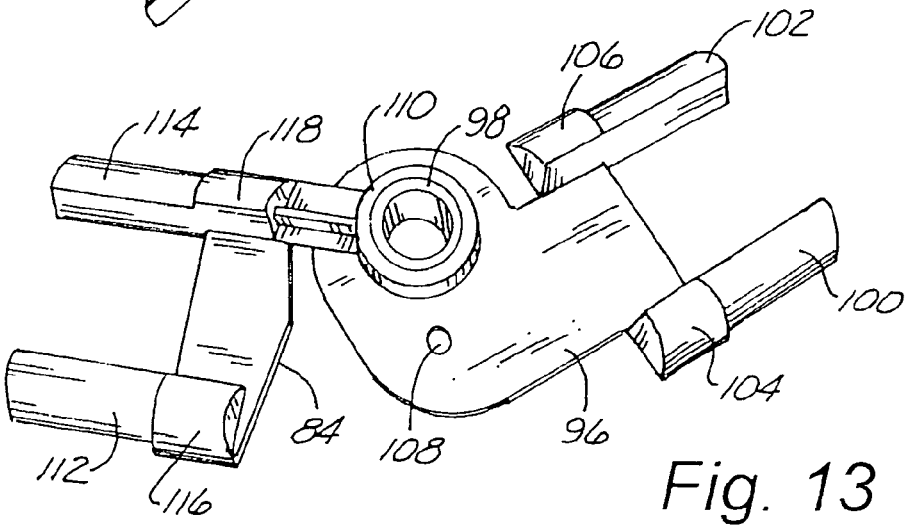
FIG. 13 is a top view of a base and ring cap of the pivot cap of the lighting system.
Figure 14:
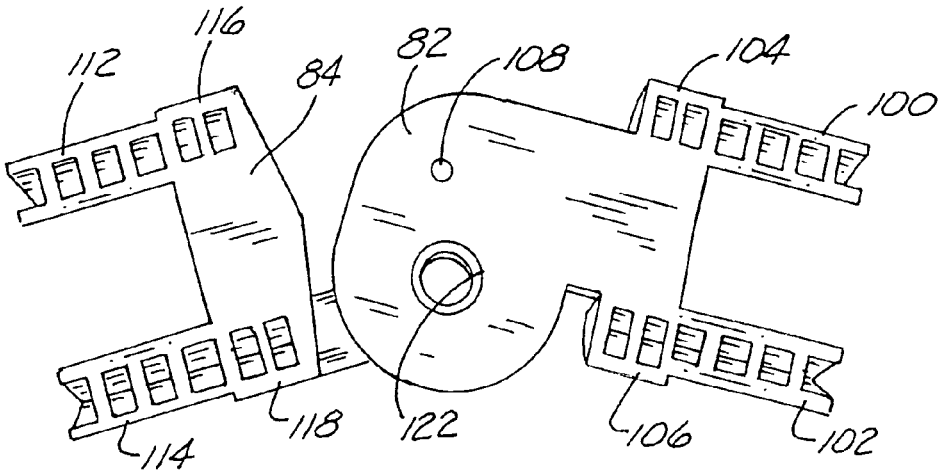
FIG. 14 is a bottom view of the base and ring cap of the pivot cap of the lighting system.
Figure 15:
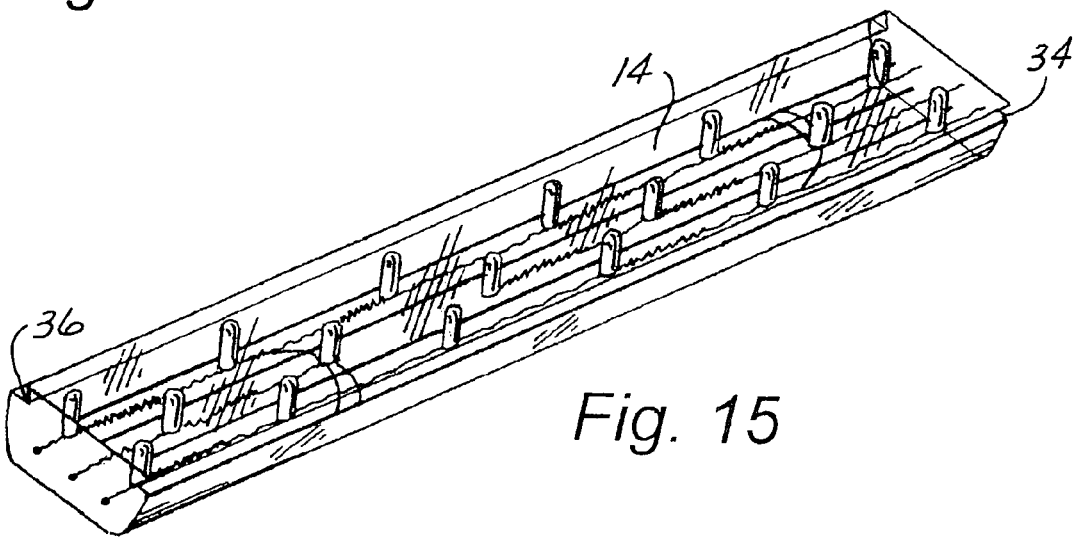
FIG. 15 is a top view of the rope light of the lighting system.

The male and female caps 78, 80 matingly align as described hereinabove and as shown in FIG. 12, the base and ring caps 82, 84 matingly align as described hereinabove and as shown in FIG. 13. The combination of the two sets of caps (78, 80 and 82, 84 respectively) align and matingly join by inserting the end of the male connector 86 through the collar 98 of the base cap 82. The ends of the male connector 86 include outwardly extending ledges 120 that snap fit into a recessed ridge 122 located in the bottom of the collar 98 of the base cap (see FIGS. 9, 14). This connection releaseably secures the components of the pivot cap 18 in such a way that the pivot cap 18 can freely pivot but still remain substantially joined. An electrical connection can be made between the rope lights 14 through the pivot cap 18 using conventional means.

The end cap 14 and pivot cap 16 can be made of any suitable material, such as plastic, acrylonitrile butadiene styrene (ABS), rigid polyvinyl chloride (PVC), and the like. Preferably, a flame retardant material would be used.

The rope light 14 is comprised of a flexible material generally in a tubular form. The material is generally some form of flexible plastic or resin such as PVC. Small lights are embedded in the material along with narrow electrical connectors. Preferably, the rope light 14 is comprised of light emitting diodes (LED) lights. The material itself can be clear or colored, and in the case of LED lights the lights can easily be different colors. The wires embedded in the rope light 14 can be easily connected to electrical wires via conventional connection means. The number of lights can vary not only by the number of lights on a string, but also the number of strings within the rope 14. Thus, rope lights 14 can be easily interconnected electrically. The rope light 14 include three strings of lights (see FIG. 16).

The system 10 can be configured to adapt to any number of installation sites by cutting the channels 12 and the rope lights 14 to length. Then the channels 12 can be attached to the underlying surface, with the rope lights inserted. The electrical connections can be made, then the caps 16, 18 attached thereby creating a permanent or semi permanent display.

Figure 17:
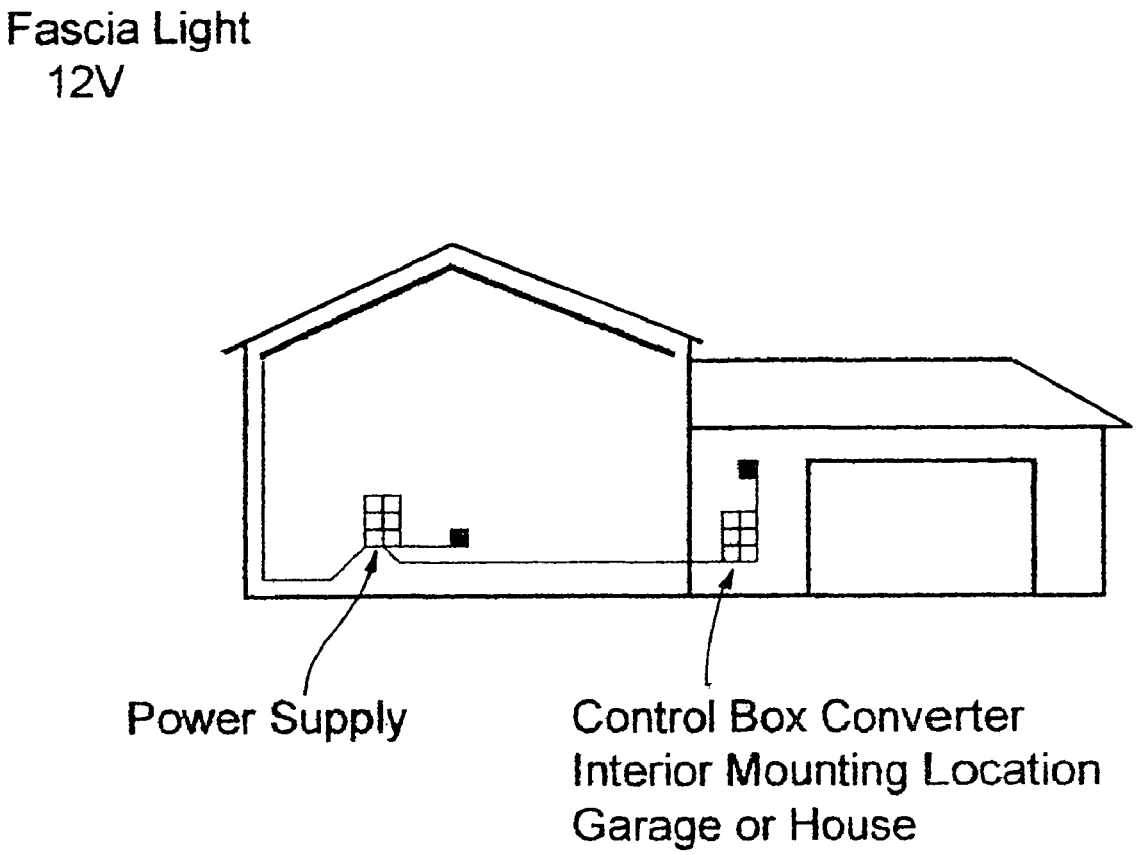
FIG. 17 is a schematic view of the lighting system.

In one embodiment, the system 10 is adapted for use as display lighting for a commercial or residential structure. FIG. 17 shows in general form the configuration of the system 10 as a display for a residential home. The system 10 includes a power supply of conventional voltage to power the system. Wiring leads to the channels/rope lights 12, 14, which would be mounted on or along the fascia of the home. The wiring would then lead to a controller mounted in some convenient area such as a garage. The controller would be used to set details of the display, such as the timing, the patterns, speed, flash frequency, colors, and the like.

The system 10 substantially eliminates the problems of the prior art. The system 10 allows for the use of high efficiency lighting, provides for a high quality lighting display, and is permanent or semi-permanent in nature. The appearance is unobtrusive and substantial enough to allow for year round use. This eliminates the need to remove seasonal lights, and creates a professional appearance, as well as allows for the use of high quality lighting products.

The foregoing description and drawings comprise illustrative embodiments of the present inventions. The foregoing embodiments and the methods described herein may vary based on the ability, experience, and preference of those skilled in the art. Merely listing the steps of the method in a certain order does not constitute any limitation on the order of the steps of the method. The foregoing description and drawings merely explain and illustrate the invention, and the invention is not limited thereto, except insofar as the claims are so limited. Those skilled in the art that have the disclosure before them will be able to make modifications and variations therein without departing from the scope of the invention.

The invention claimed is:

1. A lighting display system, comprising:

a.) a plurality of channels for mounting on a suitable display surface;

b.) a light releaseably secured within at least one of said channels;

c.) electrical means for powering said light; and d) a pivot cap comprising a male cap that inserts within a female cap to form a pivoting connection, a base cap with a collar that interconnects with a ring of a ring cap, wherein said pivot cap is for interconnection with said channels such that the channels can pivot into a position that conforms to directional changes in said display surface.

2. The lighting display of claim 1 further comprising end caps for interconnection with the ends of the said channel.

3. The lighting display of claim 1 further comprising a plurality of lights secured within said plurality of channels.

4. The lighting display of claim 1 wherein said base cap and said ring cap join with said male and female cap such that said male connector inserts though said ring and collar.

5. The lighting display of claim 1 further comprising an electronic controller for controlling the display of said light.

6. The lighting display of claim 1 wherein said channels are mounted to a display surface comprising the exterior of a building.

7. The lighting display of claim 1 wherein said channel comprises an integrally formed bottom and two sides, whereby said channel is formed thereby between to releasably secure said light.

8. The lighting display of claim 7 wherein said light is a flexible light to facilitate releaseable securement within said channel.

9. The lighting display of claim 1 wherein said light is a rope light.

10. The lighting display of claim 9 wherein said rope light is comprised of light emitting diodes.

11. The lighting display of claim 9 wherein said channel further comprises an inner channel shaped to retain said rope light.

12. The lighting display of claim 11 wherein said inner channel of said channel comprises overhanging ledges that conform in shape with ridges on said rope light to retain said rope light in said channel.

13. The lighting display of claim 1 wherein said channel further comprises sides and inner walls forming a channel therebetween.

14. The lighting display of claim 13 further comprising an end caps for interconnection with the ends of the said channel, wherein said end cap has feet that fit within said channel between said sides and inner walls of said channel.

15. The lighting display of claim 14 wherein said end cap further comprises a top cap and a bottom cap.

16. The lighting display of claim 15 wherein said feet of said end cap are located on said bottom cap.

* * * * *